United States Patent [19]

Johnson

[11] 4,252,105

[45] Feb. 24, 1981

[54] CERAMIC FIREPLACE

[76] Inventor: Richard B. Johnson, 10343 Pico Vista Rd., Downey, Calif. 90241

[21] Appl. No.: 959,351

[22] Filed: Nov. 9, 1978

[51] Int. Cl.[3] ..... F24B 7/00

[52] U.S. Cl. ..... 126/121; 126/120; 126/63; D23/97

[58] Field of Search ..... 126/121, 122, 120, 131, 126/123, 61, 63, 66, 77; D23/94, 97

[56] References Cited

U.S. PATENT DOCUMENTS

| | | | |
|---|---|---|---|
| D. 202957 | 11/1965 | Tripp | D23/97 |
| 3,220,400 | 11/1965 | Yager | 126/121 |
| 3,339,540 | 9/1967 | Kreider | 126/121 |
| 4,015,579 | 4/1977 | Wirth et al. | 126/121 |
| 4,147,153 | 4/1979 | Buckner | 126/121 |
| 4,167,177 | 9/1979 | Wiggins | 126/121 |

FOREIGN PATENT DOCUMENTS

| | | | |
|---|---|---|---|
| 635 | of 1903 | United Kingdom | 126/120 |

*Primary Examiner*—Samuel Scott
*Assistant Examiner*—Lee E. Barrett
*Attorney, Agent, or Firm*—Harlan P. Huebner

[57] ABSTRACT

A free standing ceramic fireplace having a refractory base member including a hearth extension adapted to rest on a floor of a mobile home or other type residence. The fireplace has a refractory ceramic outer shell supported on the base and extending upwardly therefrom, and has a refractory ceramic, generally spherical, combustion chamber supported within the shell and closed thereto. There is a combustion air inlet to the combustion chamber extending from below the floor and a combustion gas outlet in the combustion chamber. A flue is fitted in the gas outlet and extends upwardly through the ceiling of the room. There are aligned openings in the shell and combustion chamber for inserting solid fuel into the combustion chamber. A room air passage extends in the shell in a space outwardly of the combustion chamber and the passage has an upper opening through the shell to the room. It extends downwardly in the shell around the combustion chamber, terminating in the shell below the last chamber where a heated air storage chamber is formed. There is a continuation of the passage adjacent the base from the heated air chamber to the room.

There is a glass door for closing the opening in the shell and the opening in the combustion chamber. A thermostat actuated motor-driven fan is positioned between the heated air chamber and the passage therefrom to drive heated air into the room adjacent the base. When the fan is not operating, hot air will flow upwardly through the room air passage out of the top of the shell.

8 Claims, 8 Drawing Figures

FIG. 5.
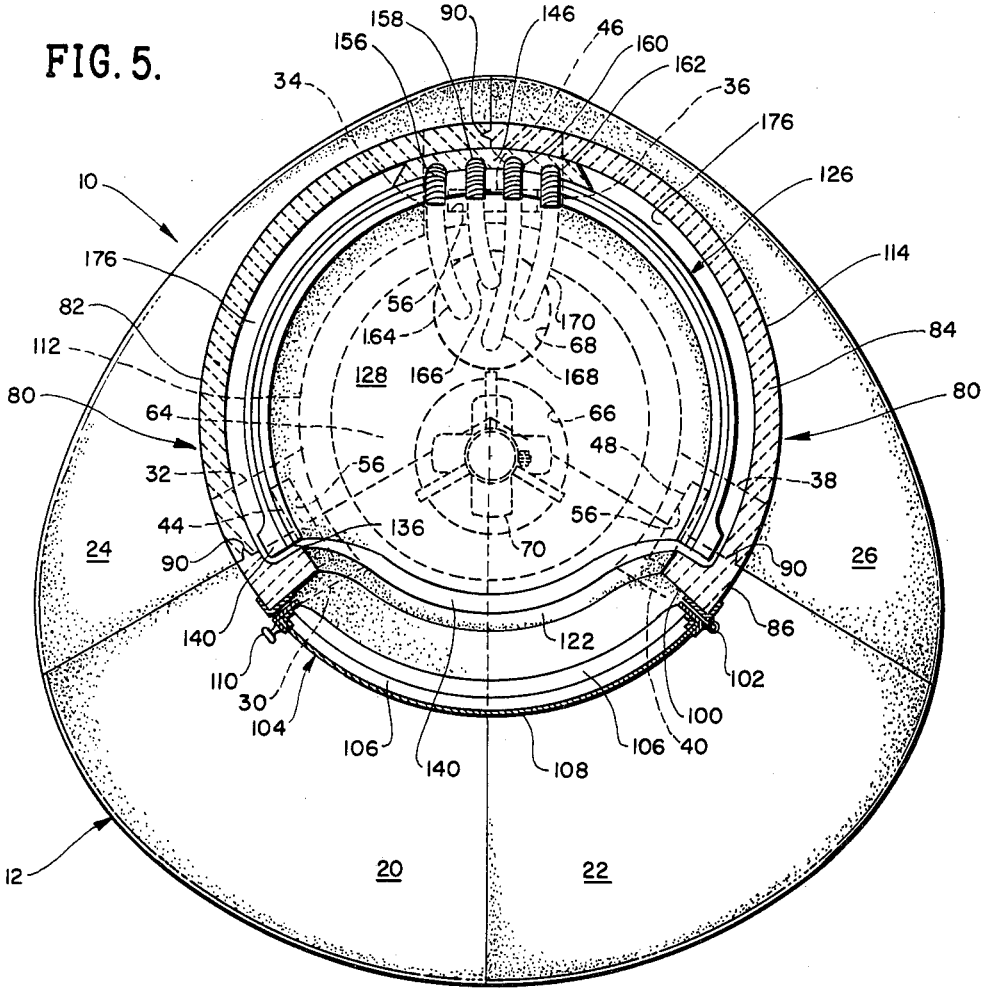
FIG. 7.
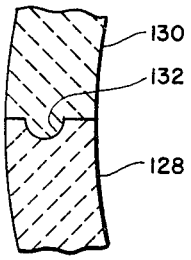
FIG. 6.
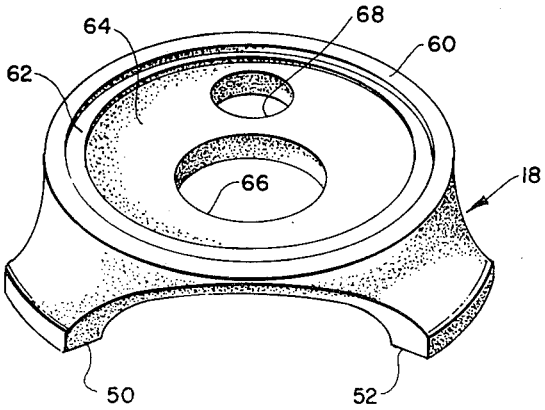
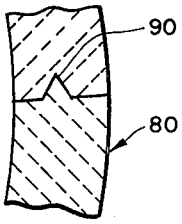
FIG. 8.

CERAMIC FIREPLACE

BACKGROUND OF THE INVENTION

In the prior art, fireplaces have mostly been built into the walls of buildings and some have been built into central parts of rooms so as to be open to the rooms with a flue entrance being spaced above the fireplace.

The typical fireplace, whether it is installed in the wall of a room or in a central portion of the room, is a very inefficient heating means in that a substantial part of the heat flows out of the chimney and generally warms the room only in the immediate area of the fireplace.

Where there is no central heating in a mobile home or other type of residence, a typical heat source has been the wood burning stove which transfers very substantial amounts of heat into the room but provides too much heat in the immediate vicinity of the stove, and not enough heat in remote areas of the room or in an adjacent room or rooms.

In the present invention, applicant has created a refractory ceramic fireplace which eliminates the heat loss from a typical fireplace, and, although being somewhat in the form of a stove, eliminates the high heat emission adjacent the structure.

SUMMARY OF THE INVENTION

The invention is a refractory ceramic fireplace having a door which, when closed, prevents the loss of heat from the room out through the flue and also provides for a highly efficient burning of a solid fuel, such as wood. By positioning a refractory ceramic shell around a combustion chamber and spaced therefrom, heated air is distributable to the room by directed convection, and air is supplied to the combustion chamber through the shell without being taken from the room.

The combustion chamber is generally spherical and it has been found that a spherical chamber is the most efficient because the heat moves toward the center and gases whirl and mix evenly with the incoming air. The result is that burning is so complete that there is no smoke or soot emitted from the chimney after the fire has been properly started.

Accordingly, it is an object of the invention to provide an improved heating device for mobile homes or residences which will heat the room it is in and those adjacent to it.

It is another object of the invention to provide a heating device, as described in the preceding paragraph, which has the attractive features of a fireplace without the inefficiency. The typical fireplace draws warm room air up the chimney, whereas the present invention draws outside air into a door-closable combustion chamber to greatly improve the heat efficiency of the fireplace. By making a door of heat resistant glass, the device provides the ability to appreciate the appearance of the burning fuel as in a typical fireplace.

It is still another object of the invention to provide a fireplace, as described in the preceding paragraphs, which is adapted to draw warm air from the ceiling and through a heat storing chamber under the combustion chamber with a thermostatically controlled fan to drive heat onto the floor of the room or through ducts into other rooms. When the fan is not running, the heat developed between the combustion chamber and the outer shell will flow upwardly out of the shell and around the flue toward the ceiling and downwardly from the ceiling along adjacent side walls.

It is a further object of the invention to provide a fireplace, as described in the preceding paragraphs, in which heat is stored between the outer ceramic shell and the combustion chamber so that very little heat is distributed by undirected convection or conduction. The outer shell is generally cool enough so that it can be touched, even though the temperatures inside the combustion chamber may be in the range of 1400° F. to 2500° F.

Further objects and advantages of the invention may be brought out in the following part of the specification wherein small details have been described for the competence of disclosure, without intending to limit the scope of the invention which is set forth in the appended claims.

BRIEF DESCRIPTION OF THE DRAWINGS

Referring to the accompanying drawings, which are for illustrative purposes:

FIG. 5 is a partially cross-sectional plan view, taken along the line 5—5 in FIG. 1;

FIG. 6 is a perspective view of a portion of the base structure which supports the shell and combustion chamber;

FIG. 7 is a fragmentary cross-sectional view, taken along the line 7—7 in FIG. 3; and FIG. 8 is an enlarged fragmentary view illustrating the vertical tongue and groove joining arrangement of the members forming the shell.

DESCRIPTION OF THE PREFERRED EMBODIMENTS

Figure 1:
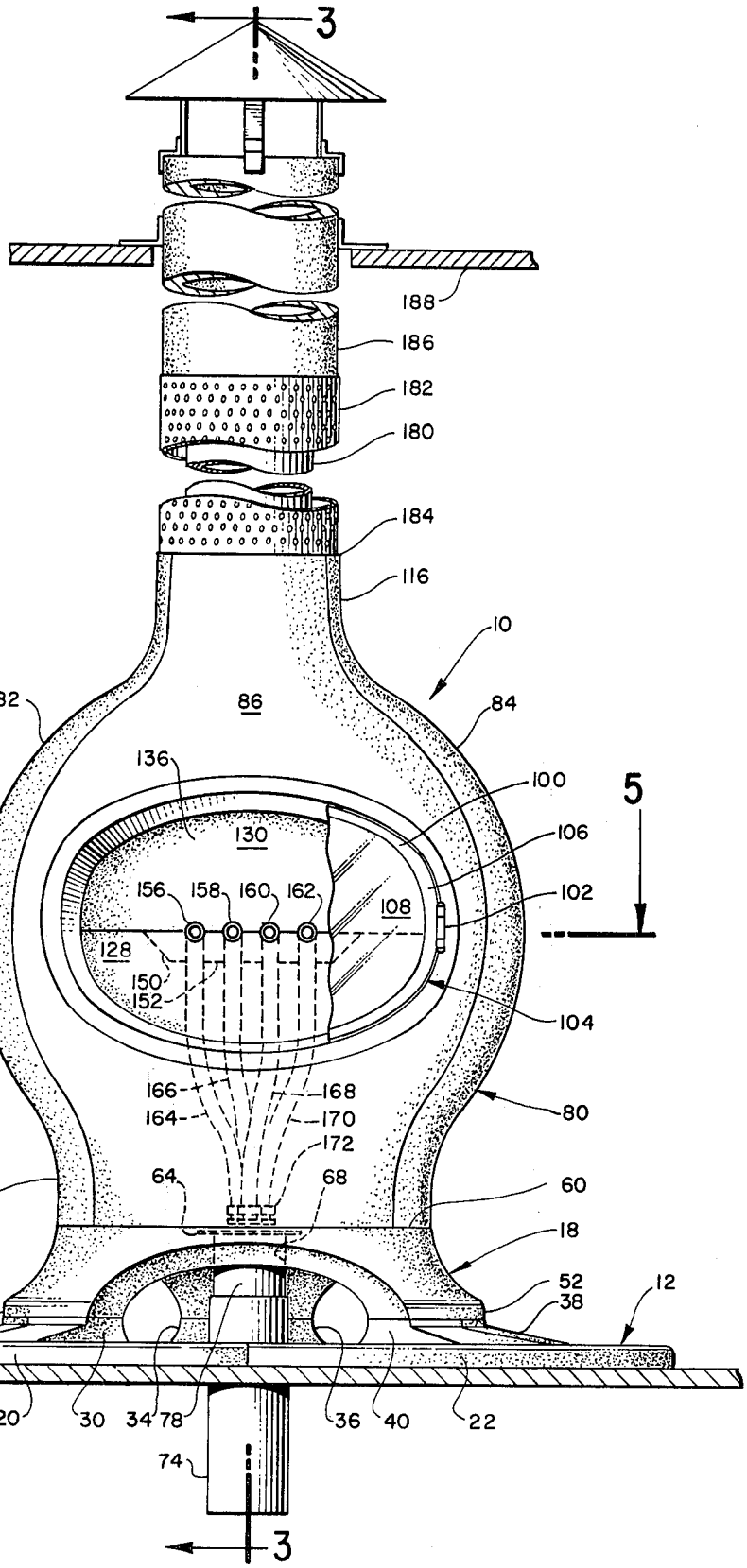
FIG. 1 is a front elevational view of the fireplace according to the invention.
Figure 3:
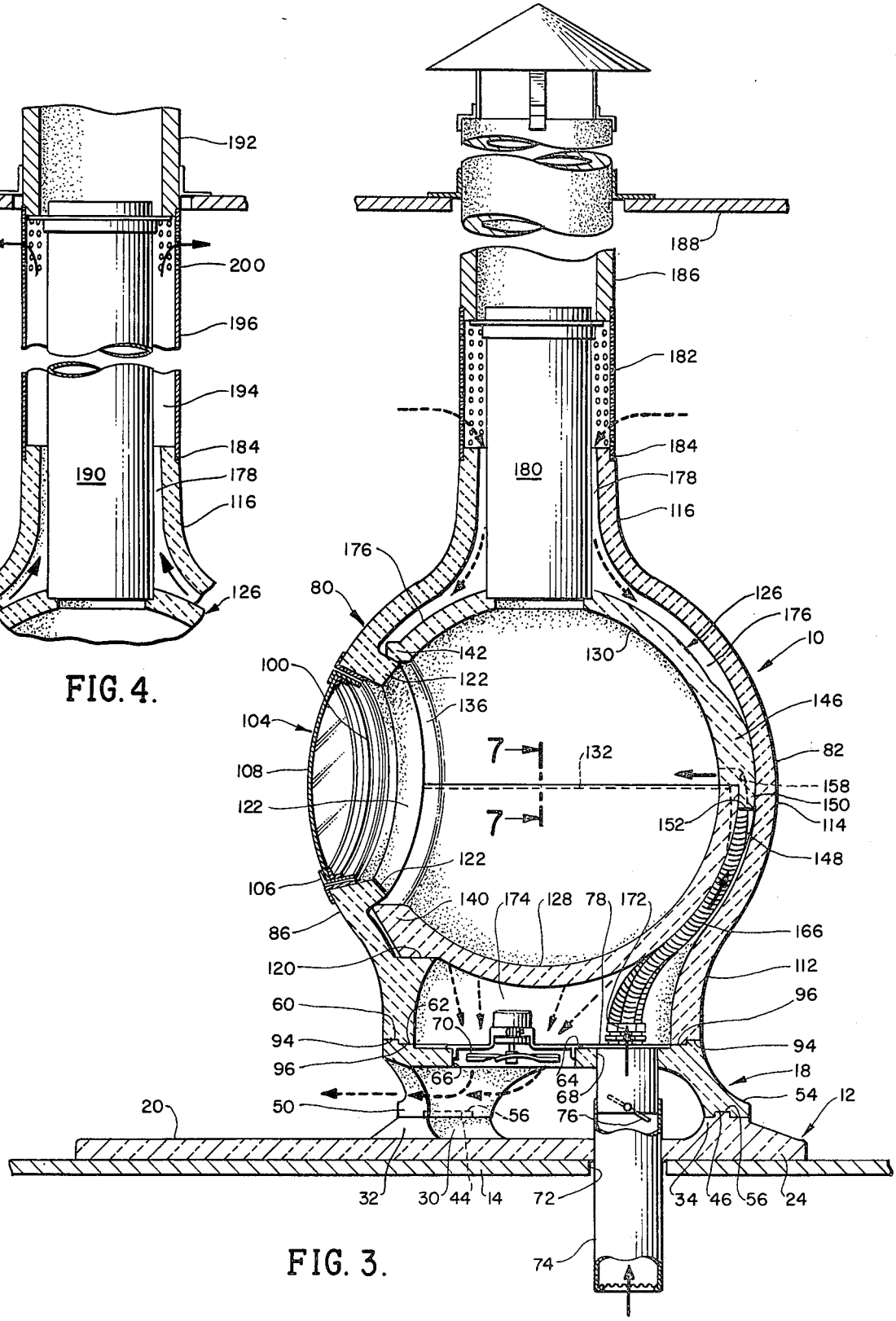
FIG. 3 is a cross-sectional elevational view of the invention, taken along the line 3—3 in FIG. 1.

Referring again to the drawings, there is shown in FIGS. 1, 3 and 5 a free standing refractory ceramic fireplace, generally designated as 10, having a hearth extension 12 supported on a room floor 14. The hearth extension and a generally annular stand 18 form the supporting base for the fireplace. The hearth extension, FIG. 3, is formed of four generally flat members 20, 22, 24 and 26, having their inner edges in abutment to form a generally circular heart-shaped member in plan view. Extending upwardly on the hearth extension are six supporting portions 30, 32, 34, 36, 38 and 40. Portions 30 and 32, 34 and 36, and 38 and 40 are in respective abutment. Each of the abutting portions, FIGS. 3 and 5, have upwardly extending abutting protrusions, rectangular in plan and elevation indicated at 44, 46 and 48, half of the protrusion being on one portion and the other half being on the adjacent abutting portion.

The annular base member 18, FIGS. 3 and 6, has three legs 50, 52 and 54. In the bottoms of the legs are rectangular recesses 56, FIGS. 3 and 5, which fit over the protrusions 44, 46 and 48 to hold the stand in place and to hold the hearth members together. At the top of the stand 18 is a flat annular surface 60 and inwardly thereof is an annular recess 62, rectangular in cross section. Inwardly of the recess 62 is a recessed top surface 64 having a large cylindrical fan opening 66 and a cylindrical air inlet pipe opening 68 therethrough. As shown in FIGS. 3 and 5, fitted in the opening 66 is a heated air, electrically driven fan 70, actuated by a thermostat, not shown. Heated air blown by the fan is vented through the spaces between the legs 50, 52 and 54.

Fitted within the opening 68 and a cylindrical opening 72 in the hearth extension is a combustion air inlet pipe 74, supported by a continuation pipe and flange 78 on the surface 64, FIG. 3. The pipe 74 also extends through the floor and permits combustion air to enter from externally of the room. Fitted within the extension 78 is a rotatable damper 76 operable within the room and adapted to close no more than three-quarters of the area of the combustion inlet to prevent a lack of combustion air, which lack could cause a flashback.

Directly supported on the stand 18 on the surfaces 60 and 62 is a refractory ceramic, generally annular shell, designated as 80, and as shown in FIGS. 1, 3 and 5, formed of three approximately equal annular sections 82, 84 and 86, fitted together along their vertical edges by V-shaped tongue and grooves 90, FIGS. 5 and 8. As shown in FIG. 3, each of the shell sections has an annular recess 94, rectangular in cross section, along its lower periphery. Inwardly of each recess 94 is an annular protrusion 96, rectangular in cross section. Each of the surfaces of the recesses 94 fit on the annular ring 60 of the stand 18, and each of the protrusions 96 fit in the annular recess 62 so that the shell is thereby held together at its lower end in the tongue and groove arrangements, at 90.

Section 86 has a front, generally oval opening 100, and hinged at 102 is a door 104 having a metal frame 106 supporting a transparent fire resistant glass central portion 108. The door is openable and closable by means of a handle 110, FIG. 5.

A lower portion 112 of the shell is generally annular and upwardly extending therefrom is a generally spheroidal portion 114, including the door. The spheroidal portion terminates in a small diameter annular top 116. As seen in FIG. 3, below the opening 100 and adjacent the top of the annular portion 112, in section 86, is an arcuate combustion chamber support shoulder 120. The opening 100 is formed to have a continuous inwardly extending lip or shoulder 122.

As best seen in FIGS. 3 and 5, fitted within the shell is a generally spherical combustion chamber 126. The combustion chamber is formed of a lower, generally hemispherical portion 128 and an upper generally hemispherical portion 130. The combustion chamber is inserted in the shell after the front section and one of the side sections are put together. The upper section 130 is supported on the lower section in a semi-circulartongue and groove arrangement 132, as shown in FIG. 7.

The assembled combustion chamber has an opening 136 in alignment with the opening 100 in the shell, so as to be openable and closable by the door 104. Surrounding the opening 136 is a lower lip or extension 140 on the lower half 128, and surrounding the opening in the upper half of the combustion chamber is an upper lip or extension 142. The lower lip 140 fits so as to be supported on its lower side on the shoulder 120, and so as to have its upper end secured in abutment with the lower side of the lip 122 of the shell. The lip 142 on the upper half of the combustion chamber is supported on the lip 122 on the shell above the opening. The immediately foregoing described structures support the combustion chamber on its front side adjacent the openings and seal the combustion chamber at the openings from the interior of the shell.

As shown in FIGS. 3 and 5, the upper and lower halves of the combustion chamber each have a protrusion 146 and 148, respectively, which extends outwardly to abut inner surfaces of the shell sections 82 and 84 so that the portion of the combustion chamber opposite the opening is thereby supported in the shell. A lower flange-shaped portion 150 of the upper protrusion 146 fits into a complementary recess 152 in the lower protrusion 148, FIG. 3.

As seen in FIGS. 1, 3 and 5, protrusions 146 and 148 and the flange portion 150 have combustion air inlet passages 156, 158, 160 and 162 opening into the combustion chamber approximately in the direction of a horizontal diameter extending through the opening 136 and midway between the top and bottom of the spherical combustion chamber. Extending downwardly from the openings 156, 158, 160 and 162 are four generally vertical passages in the lower half 128 of the chamber and the lower protrusion 148, which are connected to the combustion inlet 74 by means of four flexible fire-resistant tubes 164, 166, 168 and 170, respectively. These tubes are secured by coupling 172 connected to the flange 78 at the top of the combustion air inlet 74.

As shown in FIG. 3, positioned below the combustion chamber and within the shell portion 112 is a heated air storage chamber 174, connected through the fan opening 66 to the room. Extending upwardly from the heated air chamber 174, generally between the exterior surface of the combustion chamber and the interior surface of the shell is a warm, room air flow passage 176, FIGS. 3 and 5. Upwardly of the combustion chamber, the passage 176 terminates in an annular passage 178 which extends around a flue 80 sealingly fitted within an opening at the top of the combustion chamber to exhaust the burned gases therefrom. In FIG. 3, the room air passage portion 178 terminates at the top of the shell and at that point is open to the room. For decorative purposes, and to hold the three sections of the shell together at the top, a perforated tube 182 fits in an annular cut-a-way portion 184 in the three shell sections. The tube 182 is perforated to provide an air passage from the shell to the room and vice versa.

The embodiment shown in FIGS. 1 and 3 has been created for use with a low ceiling, such as a 6', as may be found in a mobile home. For such a structure, it is desirable that the warm, room air passage be low because of the ceiling and open to the room at the top of the shell. Fitted into the tube 182 and forming a continuation of the flue 180 is a Metalbestos chimney 186 extending through the ceiling 188 and outwardly thereof for discharge of the combustion gases to the atmosphere.

Figure 4:
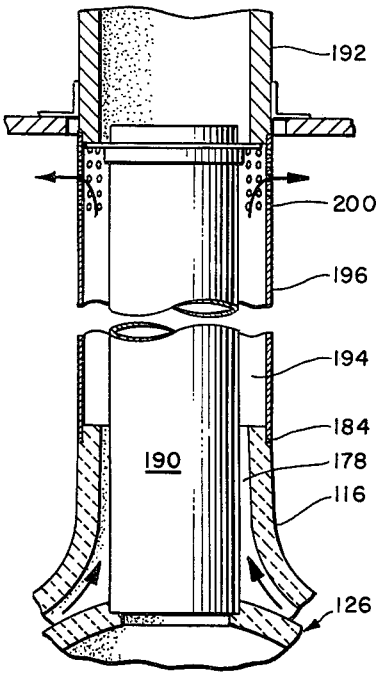
FIG. 4 is a fragmentary view of the flue and shell connection illustrating an embodiment distinctive from that in FIG. 3.

In FIG. 4, a modified version of the warm, room air passage and flue is illustrated for use in a typical, permanently located residential structure, in contrast to a mobile home. Here, the flue 190 extends to the room ceiling where it is connected to a Metalbestos chimney 192 extending outwardly of the room for atmospheric discharge of the combustion gases. The passage 178 is extended into an annular passage 194 having an outer wall 196 formed of black metal pipe. The lower end of the pipe 196 fits into the annular cut-a-way 184 at the top of the shell to secure the three members together. Fitted on the top of the black pipe 196 is a perforated tube 200, connecting the room to the warm air passages 194, 178 and 176.

Figure 2:
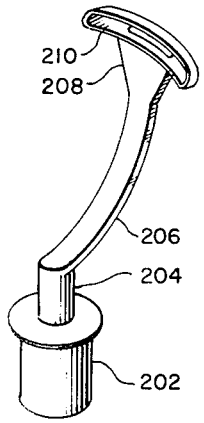
FIG. 2 is a perspective view of an embodiment of a combustion air inlet distinctive from that shown in FIG. 1.

In FIG. 2 another embodiment of a combustion air inlet is illustrated. Here, a combustion inlet tube 202 extends below the floor as does the equivalent tube 74 in FIG. 1, and connected to the tube 202 is a single tube 204 extending above the surface 64 of the base member 18. Instead of having four individual passages extending upwardly into the protrusions 146 and 148, a single curved tube 206 is employed and it terminates in a widening portion 208 having at its end an arcuate shaped opening 210 which fits into an opening in the inner surface of the chamber to supply combustion air thereto.

In operation, solid fuel, such as wood, is used in the combustion chamber, and the fire may be typically started with kindling and paper with the damper 76 fully opened, and any flue damper in its open position. The door 104 may be opened to speed up the ignition of the fire, but after the fire is going the door should be closed, because when open, it permits too much heat to be lost through the flue and also causes a much faster burning fire than necessary to obtain the heat needed or desired from the fireplace. By having the door made of glass, the fire can be viewed when it is closed.

As the heat builds up around the combustion chamber in the passage 176 and the storage chamber 174, it will tend to flow upwardly in the direction of the arrows, shown in FIG. 4, and out of the shell into the room through the perforations in the tube 200 or the perforations in the tube 182. Flow in the residential model, shown in FIG. 4, will typically move along the ceiling and down the walls to the floor. This type of flow may be adequate to heat the space evenly, depending upon the size of the room or rooms and the amount of heat needed.

To obtain a maximum amount of heat out of the fireplace, the thermostat-actuated fan 70 is used, the thermostat being set to keep the area temperature constant. When the fan is turned on, it draws room air into the perforations in the tubes 182 or 200 and down into the passages 178, 176 and into the storage chamber 174. By the time the room air reaches the chamber 174 it is very warm and the fan blows it out, as indicated by the arrows in FIG. 3, between the legs of the base member 18. The arrows tend to indicate that the air would be moved along the floor only between the front legs and this would almost be true if the fireplace were positioned in a corner, but in any event the air would be blown in all directions between the legs of the base member 18.

With the fan off and the fire burning slowly, as it may be regulated by the dampers, it will tend to burn all night and emit warm air upwardly adjacent the top of the shell or adjacent the ceiling through the perforations.

The combustion chamber and the shell are made of high quality clay adapted to stand severe thermal shock, the clay being at least 50% of the alumina type. To strengthen the combustion chamber and the shell, thin 1" stainless steel wires are molded into the clay. The clay is of a quality to have a low coefficient of expansion so that the shell and combustion chamber parts do not move significantly as they are heated.

Temperatures within the combustion chamber typically range between 1400° F. and 2500° F. For a combustion chamber having a diameter of 23" and a flue diameter of between 6¾" and 7", the combustion air to it should flow through a passage providing a continuous opening of between 3 and 4 square inches. For example, the circular openings in FIG. 1 are each 1" in diameter and thus the flow provided by the four openings is somewhat greater than 3 square inches. Similarly, the combustion air inlet, illustrated in FIG. 2, should have no tubular area of less than 3 square inches, and preferably should be between 3 and 4 square inches throughout.

The combustion chamber wall is about 1½" thick and is made of clay having a high conductivity so as to permit rapid heating of the air space between the chamber and the shell, the air space being a minimum of about ¾". The shell sections have a low thermal conductivity and are about 1¼" thick. Typically when there is a hot fire in the chamber the shell can be touched without burning. The hearth extension 12, as may be visualized from FIG. 5, can be against a room wall and the shell as close as 1" to a wall without fire danger.

In the embodiment shown in FIGS. 1 and 3, the perforated tube 182 is about 12" in length and is spaced about 1" from the exterior of the flue. The flue is typically made of stainless steel 430 or fire clay tile.

In the embodiment shown in FIG. 4, the O.D. of the flue may be about 8" and the O.D. of the tube 196 about 10", and the perforated tube 200 should be about 10" in length and may be of the diameter as shown, or larger than the tube 196, such as 12" in diameter to permit a greater air flow therethrough.

The high temperature of the fire in the combustion chamber is sufficient to provide complete combustion with a relatively small amount of ash remaining. There is no smoke or soot discharged from the chimney after the fire is properly started.

Because of the low conductivity of the shell, there is no sudden flow of uncomfortable heat into the room as from typical stoves because the heat is temporarily stored in the space around the combustion chamber, and in the storage chamber thereunder, before it is dispersed slowly throughout the area being heated.

The invention and its attendant advantages will be understood from the foregoing description and it will be apparent that various changes may be made in the form, construction and arrangements of the parts of the invention without departing from the spirit and scope thereof or sacrificing its material advantages, the arrangements hereinbefore described being merely by way of example. I do not wish to be restricted to the specific forms shown or uses mentioned except as defined in the accompanying claims, wherein various portions have been separated for clarity of reading and not for emphasis.

I claim:

1. A free standing ceramic fireplace, comprising:

a base adapted to rest on a floor, a refractory ceramic outer shell supported upwardly from said base and extending upwardly therefrom, a refractory ceramic combustion chamber supported within said shell and closed thereto, a combustion air inlet to said combustion chamber and a combustion gas outlet in said combustion chamber, a flue fitted in said outlet and extending upwardly therefrom, aligned openings in said shell and combustion chamber for inserting fuel into the combustion chamber, and a room air passage in said shell, said passage having an upper opening to the shell and to the room above the top of the shell, said passage extending downwardly in said shell around said combustion chamber and terminating in said shell below said combustion chamber, said combustion chamber being generally spherical internally inwardly of said opening, said combustion chamber being generally spherical exteriorly beyond said opening and having a non-spherical protrusion extending therefrom opposite said opening, said protrusion being adapted to provide space for said combustion air inlet and to provide means on which the combustion is partially supported in the shell.

2. The invention according to claim 1 including:

a door for closing the opening in said shell and the opening in said combustion chamber.

3. The invention according to claim 1 including:

a thermostat actuated, motor driven fan between said heated air chamber and said passage therefrom to drive the heated air into the room adjacent the base.

4. The invention according to claim 1 in which:

said flue extends upwardly above the shell and through the room for external discharge of said combustion gas, said top of the shell extending upwardly to surround a portion of said flue and being spaced therefrom to provide a portion of said room air passage within the upper part of the shell between the shell and flue, said portion of the room air passage being open to the room outwardly of the flue.

5. The invention according to claim 4 including:

a perforated tube surrounding and spaced from said flue within the room and being associated with the top of the shell, said perforated tube being adapted to extend upwardly toward the ceiling, said perforated tube providing a room air path to the room through the perforations around the flue and downwardly into the shell around the flue and said perforated tube having perforations along its entire length and circumferentially therearound.

6. The invention according to claim 1 in which:

said combustion chamber is formed of two parts, an upper part positioned on a lower part, said protrusion partially formed on each of said parts, extensions on said combustion chamber above and below said openings, shoulders in said shell above and below said openings to support said respective extensions on said combustion chamber.

7. The invention according to claim 6 in which:

said shell is formed of three vertically standing parts having generally vertically extending edges fitted together, one of said parts having said fuel feeding opening, a shell stand support securely fitted in said base, a generally cylindrical lower portion of said shell securely fitted and supported in said stand, an enlarged spheroidal portion of the shell extending upwardly from said lower portion and surrounding said combustion chamber and being generally spaced therefrom, means opposite said shoulders associated with the shell and combustion chamber for supporting said combustion chamber in said shell, an upper shell small diameter portion extending from the spheroidal portion and surrounding a portion of said flue and being spaced therefrom.

8. The invention according to claim 7 including:

means surrounding and spaced from said flue externally of said shell and forming a portion of said room air path around the flue to the shell, said means being engaged with the top of the shell to secure the three parts of the shell together adjacent the top.

* * * * *